United States Patent [19]

Wiggins

[11] Patent Number: 4,948,010

[45] Date of Patent: Aug. 14, 1990

[54] WASTE LIQUID COLLECTION AND DISPOSAL APPARATUS

[76] Inventor: E. Todd Wiggins, Rt. 4 Box 1099-80, Edmond, Okla. 73034

[21] Appl. No.: 334,630

[22] Filed: Apr. 7, 1989

[51] Int. Cl.[5] ..... B65D 88/54

[52] U.S. Cl. ..... 220/85 S; 137/398; 222/67; 417/36; 417/40; 417/120

[58] Field of Search ..... 137/397–399; 220/85 S; 222/67, 68; 417/36, 40, 92, 101, 120, 126, 129

[56] References Cited

U.S. PATENT DOCUMENTS

| | | | |
|---|---|---|---|
| 974,261 | 11/1910 | Griffiths | 417/101 |
| 1,582,855 | 4/1926 | Peter | 222/68 |
| 2,260,312 | 10/1941 | Gruman | 417/36 |
| 2,564,548 | 8/1951 | Sjoberg | 417/101 |
| 2,626,740 | 1/1953 | Levy | 417/101 |
| 2,956,581 | 10/1960 | Pearson | 417/36 |
| 3,255,922 | 6/1966 | Socol et al. | 222/67 |
| 3,279,001 | 10/1966 | Lenz | 137/398 |
| 4,321,017 | 3/1982 | Gottliebson | 417/129 |

*Primary Examiner*—Jimmy G. Foster

[57] ABSTRACT

In a liquid waste collection and disposal apparatus, liquid waste gravity flows to a tank through a check valve equipped inlet line. A vertical guide float within the tank controls the liquid level therein. A two-way tank venting solenoid operated valve supplies gas, under pressure, to the tank for evacuating liquid therein. An electrical circuit connects a source of electrical energy with liquid upper and lower limit magnetic switches disposed in the path of travel of the float for energizing the actuator of the solenoid valve to evacuate the fluid therein through a check valve equipped discharge line in response to the float closing the upper limit switch. When the float reaches the limit of its downward movement, the normally closed lower magnetic switch is opened to interrupt gas pressure to the tank.

4 Claims, 1 Drawing Sheet

WASTE LIQUID COLLECTION AND DISPOSAL APPARATUS

BACKGROUND OF THE INVENTION

1. Field of the invention.

This invention relates to the oil industry and more particularly to a collection apparatus for waste oils, salt water or other environmental polluting liquids.

On oil field production sites both on and off shore a hazard to the environment exists due to improper disposal of such waste liquids.

This invention provides an apparatus for the collection and proper disposal of waste liquids.

2. Description of the prior art.

Oil drained from the crankcases of compressors or engines is frequently collected in buckets or pans and carried to a disposal tank on location. In some cases the waste oil is simply allowed to drain on or be poured into the ground where it creates the hazard of entering water streams or leaching into ground water aquifers. Further, in the dehydration gas process, utilizing chemicals which remove liquids from the gas stream before it is pumped to a user's supply line, these liquids are frequently drained by gravity into a container, such as an oil drum. The drum has its wall perforated and is buried below the surface of the earth. The liquids flowing thereinto are thus drained into the surrounding soil, generating a potential for ground water degradation and a leaching of such liquid into the ground water aquifer.

This apparatus provides for a collection, by gravity, of liquids from such sources which, when a predetermined quantity of liquid is collected, is moved by gas pressure to a proper disposal or recycling tank.

SUMMARY OF THE INVENTION

A normally vented fluid tight container, such as a small tank, is provided with a check valve equipped gravity flow liquid inlet line communicating with its interior through the upper surface of the tank. Similarly, a check valve equipped drain line is connected at one end with the bottom of the tank and communicates at its other end with a pipe extending to a relatively large capacity storage or collection tank. The liquid collecting tank contains a magnetic float moved vertically along a guide path with the level of fluid collected therein. A relay energized solenoid operated two-way valve, connected with the upper limit of the tank, supplies a source of gas under greater than atmospheric pressure to the tank above the fluid level therein when the float reaches a predetermined elevation within the tank. An electric circuit connects a source of electrical energy with a pair of upper and lower limit switches disposed in the path of and opened and closed by vertical movement of the magnetic float. The float closing the upper magnetic switch energizes a relay and shifts the solenoid operated valve to allow gas pressure to enter the tank. This gas pressure discharges the collected liquid through the tank drain line and the float opens the lower magnetic switch deenergizing the relay and the solenoid valve. The solenoid operated valve then vents the gas pressure within the tank to the atmosphere to allow additional waste liquid to enter the tank. The source of energy is preferably a battery maintained at full potential by a solar panel mounted adjacent the apparatus.

The principal object of this invention is to provide an apparatus which will collect and dispose of waste liquids in order to eliminate some of the sources of environmental pollution by equipment used in the petroleum production industry.

DESCRIPTION OF THE PREFERRED EMBODIMENTS

Figure 1:
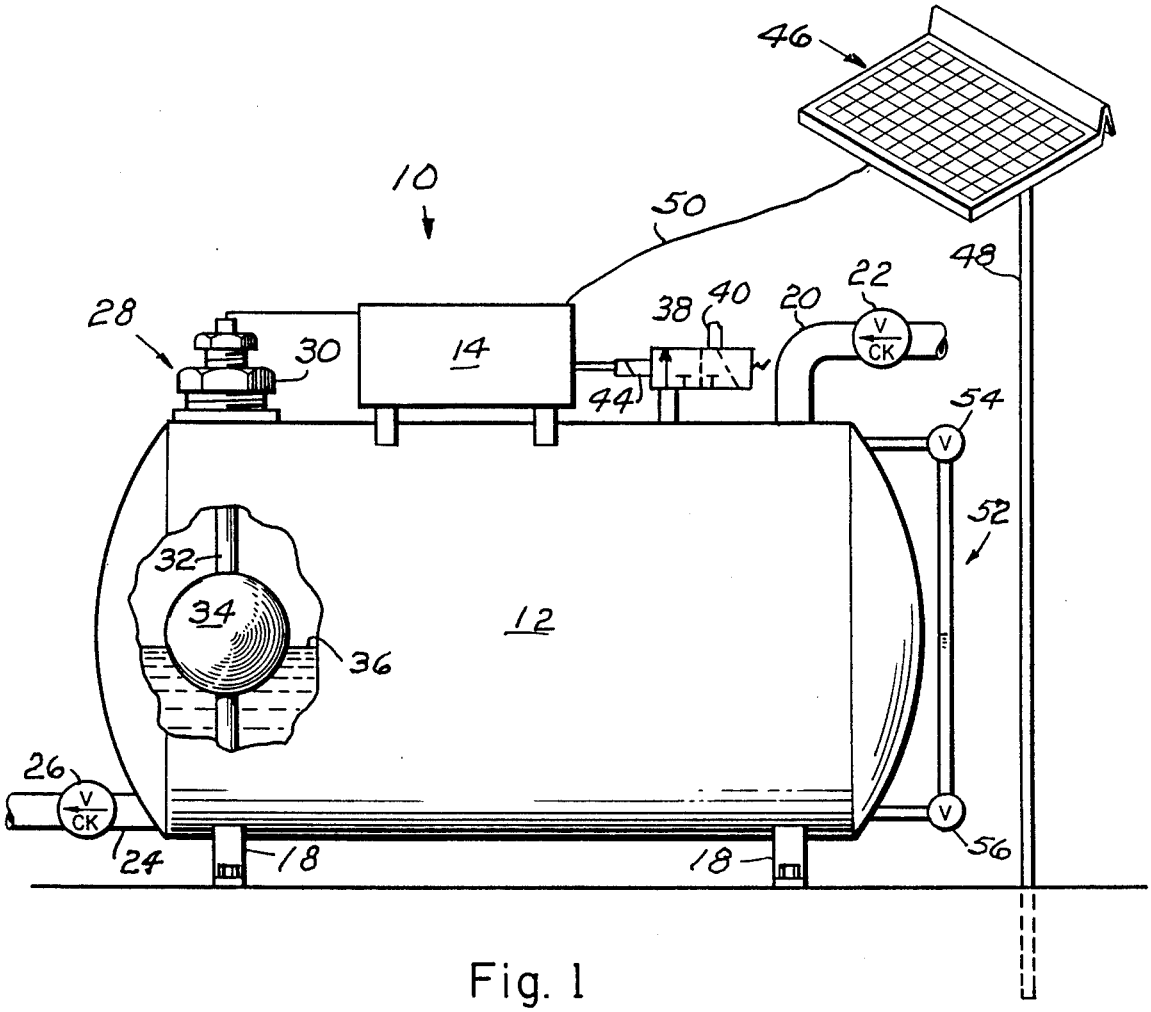
FIG. 1 is a side elevational view of the apparatus with parts broken away for clarity; and, FIG. 2 is a wiring diagram.
Figure 2:
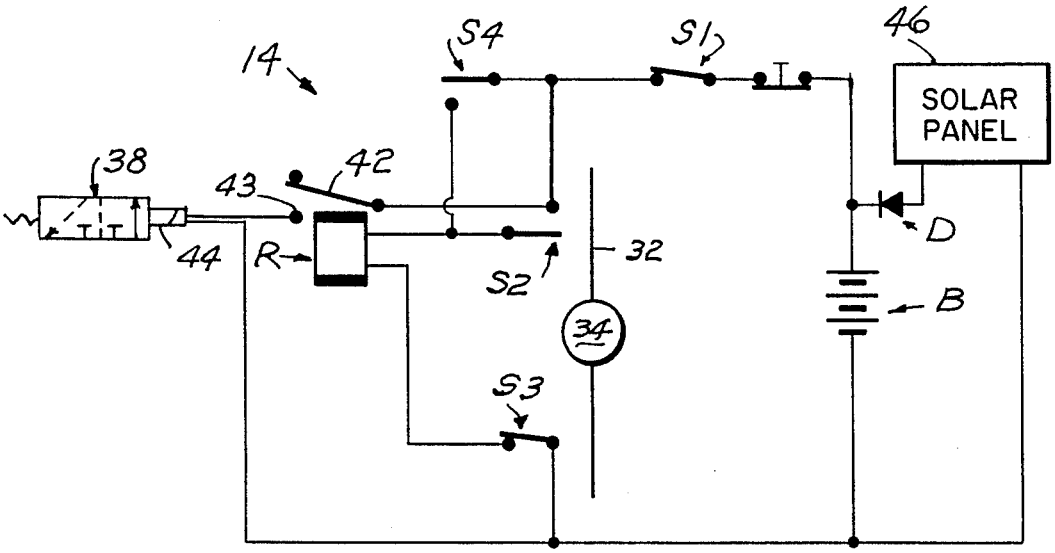

Like characters of reference designate like parts in those figures of the drawings in which they occur.

In the drawings:

The reference numeral 10 indicates the apparatus, as a whole, comprising a container or tank 12 and an electrical control apparatus 14. In the example shown, the tank 12 is cylindrical and is mounted on a base 16 by legs 18. The upper limit of the tank is connected to and communicates with a gravity flow line 20, having a check valve 22 interposed in the line, which collects and transfers oil to the tank 12. Adjacent its bottom or lower limit, the tank is provided with another line 24 which contains an outlet check valve 26 for exhausting fluid from the tank. This line 24 is connected with a disposal tank, not shown, remote from the tank 12. One end of the tank, preferably opposite the inlet line 20, contains a magnetic float means 28.

The float means 28 comprises suitable packing gland-type connections 30, for the reason presently explained, connected with the top limit of the tank 12 and includes a vertical float guide tube or rod 32 for maintaining a float 34 moving vertically in response to the level of liquid 36 contained by the tank. Additionally, a solenoid operated valve 38 is connected with the upper limit of the tank and supplies, by a line 40, a gas, under greater than atmospheric pressure.

The electrical control apparatus 14 includes a battery B and a relay R. The battery is connected to one terminal of the relay R coil through a normally closed off/on switch S1 and a magnetic normally open float closed liquid upper limit magnetic switch S2. The negative of the battery is connected to the other terminal of the relay R coil through a second normally closed float opened liquid lower limit magnetic switch S3. Wires connect the switches S2 and S3 with the battery through the connections 30. One terminal of the switch S2 is connected with one terminal of the valve 38 solenoid actuator 44 through the normally open armature 42 of the relay R. The other terminal of the solenoid valve actuator 44 is connected with the negative of the battery B. A manually operated normally open switch S4 is connected in parallel with the magnetic switch S2 to the first named terminal of the relay R coil.

A solar panel 46, mounted at a suitable location on or near the tank 12, as on a rod 48, or the like, is connected with the battery B by wires 50 through a diode D. Additionally a sight glass 52 is connected with the upper and lower limit or the tank 12 by sight glass valves 54 and 56 for visually indicating the fluid level 36 within the tank.

OPERATION

In operation, waste liquid collects in the tank 12 until the float 34 reaches a predetermined upper limit and closes the magnetic switch S2, energizing the coil of relay R and closing its armature 42 with its contact 43 which energizes the solenoid actuator 44 and shifts the solenoid valve 38. This applies gas pressure through the line 40 to the interior of the tank above the liquid therein and exhausts the liquid through the line 24. When the float 34 reaches the lower limit of its travel, it opens the magnetic switch S3 deenergizing relay R coil and the solenoid actuator 44 which shifts the solenoid valve 38 to vent position and vents any residual gas pressure within the tank so that waste liquid flow may continue into the tank through the gravity flow inlet line 20.

At any time it is desired to manually empty the waste fluid collected in the tank, the manual switch S4 may be closed which energizes the coil of the relay R and the actuator 44 of the solenoid valve 38, as described hereinabove. Repeated closing of the manual switch S4 will completely empty the tank 12, if desired.

Obviously the invention is susceptible to changes or alterations without defeating its practicability. Therefore, I do not wish to be confined to the preferred embodiment shown in the drawings and described herein.

I claim:

1. A waste liquid collecting and disposal apparatus, comprising:

a fluid tight tank having upper and lower limits;

liquid inlet and outlet pipe means communicating with the interior of said tank adjacent its upper and lower limits, respectively, for movement of liquid into and out of the tank;

valve means connecting a source of gas under greater than atmospheric pressure with said tank;

float means including a vertically moveable float within said tank for monitoring the quantity of liquid in said tank;

magnetic switch means disposed at the respective upper and lower limit of float movement; and, electric circuit means connecting a source of electrical energy with said magnetic switch means for operating said valve means in response to predetermined positions of said float.

2. The apparatus according to claim 1 in which said valve means includes:

a two-position solenoid actuated valve normally venting said tank to the atmosphere.

3. The apparatus according to claim 2 in which said circuit means includes:

a relay interposed in the circuit between said magnetic switch means for energizing and deenergizing the solenoid of said valve means in accordance with the open or closed position of said magnetic switches.

4. The apparatus according to claim 3 and further including sight glass means connected with said tank for visually indicating the quantity of liquid therein.

* * * * *